United States Patent [19]

Mitter

[11] 3,958,507

[45] May 25, 1976

[54] COUNTER-PRESSURE BEAM FOR USE IN SCREEN PRINTING MACHINES AND STIFFENING MEANS THEREFOR

[75] Inventor: Mathias Mitter, Verl-Sende-Mitte, Germany

[73] Assignee: Mitter & Co., Schloss Holte, Germany

[22] Filed: June 19, 1974

[21] Appl. No.: 479,946

[30] Foreign Application Priority Data

June 20, 1973 Germany ..... 2331464

[52] U.S. Cl. ..... 101/126; 52/291; 101/407 R

[51] Int. Cl.[2] ..... B41F 15/24

[58] Field of Search ..... 101/116, 126, 407 R, 101/407 BP, 407 A, 269, 216; 198/208; 52/291, 223 R, 225

[56] References Cited

UNITED STATES PATENTS

| | | | |
|---|---|---|---|
| 2,578,413 | 12/1951 | Ford | 101/216 |
| 3,305,988 | 2/1967 | Halopoff | 52/291 |
| 3,605,364 | 9/1971 | Ford | 52/291 |
| 3,795,188 | 3/1972 | Giani | 101/126 X |
| 3,830,155 | 8/1974 | Pinedo | 101/269 |

*Primary Examiner*—Edgar S. Burr
*Assistant Examiner*—R. E. Suter
*Attorney, Agent, or Firm*—Michael J. Striker

[57] ABSTRACT

A screen printing machine wherein the stencil rotates above a hollow counter-pressure beam having a rectangular profile and carrying a removable strip which engages the underside of the back cloth. The beam is stiffened by two tie rods which are adjacent to its side faces and extend through bearings affixed to the lower portion of the beam. Upward flexing of median portions of the tie rods is prevented or controlled by vertical bolts which mesh with brackets secured to the beam and whose lower end portions abut against flats on the median portions of the respective tie rods. The tie rods are tensioned by nuts so that they prevent the median portion of the beam from sagging under its own weight and/or due to pressure which is exerted by the central portion of the stencil through the medium of the fabric and back cloth.

18 Claims, 4 Drawing Figures

102
2a
202
3
1
2
4
12
11
F
II
112

COUNTER-PRESSURE BEAM FOR USE IN SCREEN PRINTING MACHINES AND STIFFENING MEANS THEREFOR

BACKGROUND OF THE INVENTION

The present invention relates to screen printing machines in general, and more particularly to improvements in means for applying pressure against that portion of a moving web of fabric or the like which is in contact with the stencil.

It is well known to employ in a screen printing machine a counter-pressure beam which is disposed opposite the stencil and defines with the latter a gap for the passage of a web of the material to be printed and of the customary back cloth. The stencil is a hollow cylinder or an endless band which is trained over several rollers including at least one tensioning roller. A liquid applying device or squegee (e.g., a roll) is mounted in the interior of the stencil to supply a liquid in the region where the stencil contacts the fabric whereby the stencil allows the liquid to come into contact with selected portions of the moving fabric to form thereon a design of predetermined configuration.

A drawback of presently known counter-pressure beams is that they are likely to sag midway between the ends so that the pressure between the stencil and the fabric varies from the marginal portions toward the center of the fabric. This affects the quality of the printing operation; in fact, it can happen that the pressure midway between the ends of the stencil is so low that the liquid cannot contact the median portion of the fabric.

SUMMARY OF THE INVENTION

An object of the invention is to provide a novel and improved counter-pressure assembly which can be used in a screen printing machine to insure that the width of the gap wherein the fabric passes between a cylindrical or band-like stencil and the counter-pressure assembly remains constant or assumes a shape which is best suited for the transfer of liquid to selected portions of the fabric.

Another object of the invention is to provide novel and improved means for stiffening or reinforcing the counter-pressure beam in a screen printing machine.

A further object of the invention is to provide a screen printing machine which embodies the improved counter-pressure assembly.

An additional object of the invention is to provide a counter-pressure assembly which can be adjusted so as to regulate the width of the entire gap or the width of selected portions of the gap between the beam and the stencil in a screen printing machine.

Still another object of the invention is to provide a counter-pressure assembly which can be utilized with advantage in screen printing machines for relatively narrow or very wide webs of material to be printed, wherein the beam is stiffened by simple, long-lasting and rugged means, and which can be installed in presently known screen printing machines as a superior substitute for conventional counter-pressure beams.

A feature of the invention resides in the provision of a counter-pressure assembly for use in a screen printing machine wherein a web or sheet of material to be printed moves lengthwise along a predetermined (e.g., horizontal) path, and a driven endless liquid-permeable stencil is adjacent to one side (preferably the upper side) of the path and is designed to permit a liquid (e.g., tusche, dye or ink) to contact selected portions of the web. The counter-pressure assembly is adjacent to the other side of the path opposite the stencil and comprises an elongated beam (e.g., a hollow tubular body having a polygonal and preferably a rectangular profile) extending transversely of the path for the material to be printed and means for stiffening the beam so as to prevent a flexing of the beam in response to application of bending stresses in a region intermediate the ends of the beam. The stiffening means is preferably adjacent to that portion of the beam which is remote from the path for the material to be printed, and such stiffening means may comprise one or two elongated tie rods which are adjacent to the side faces in the region of the aforementioned portion of the beam and devices for securing the ends of the tie rods to the beam. In order to prevent excessive (or any) flexure of the tie rod or rods, the assembly preferably further comprises means for controlling or preventing the flexure, and such means may include carriers attached to or made integral with the beam between the tie rods and the path for the material to be printed and externally threaded members meshing with the carriers and extending into close proximity of or into actual abutment with intermediate portions of the tie rods.

The novel features which are considered as characteristic of the invention are set forth in particular in the appended claims. The improved counter-pressure assembly itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 2:
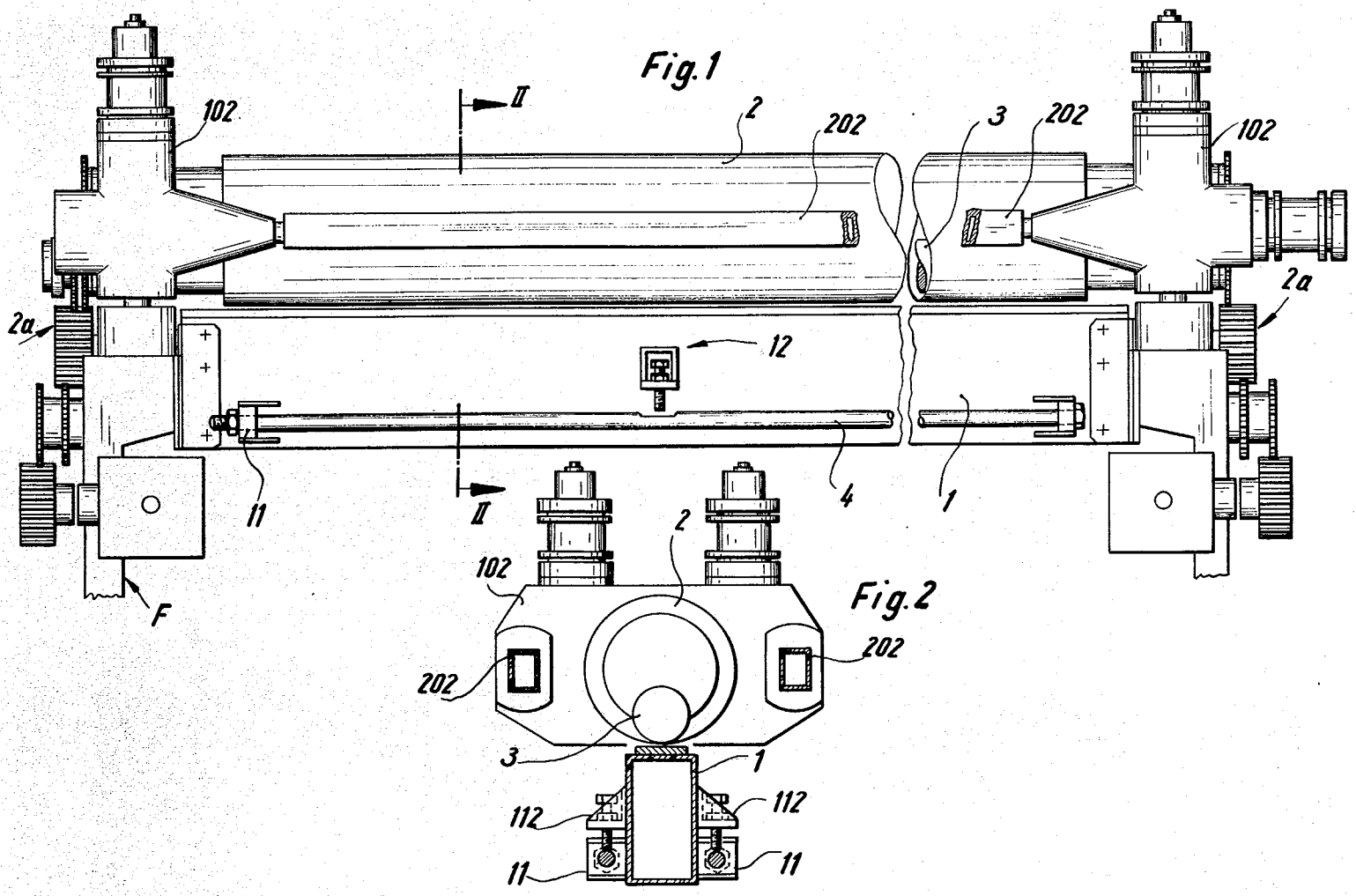
FIG. 1 is a fragmentary partly elevational and partly sectional view of a screen printing machine including a counter-pressure assembly which embodies the invention.
FIG. 2 is a transverse vertical sectional view as seen in the direction of arrows from the line II—II, of FIG. 1.

FIGS. 1 and 2 show certain details of a screen printing machine which embodies the improved counter-pressure assembly. The machine comprises a hollow cylindrical stencil or screen 2 which is rotatable by one or two trains of gears 2a and surrounds a driven liquid-applying roll 3. The holders for the ends of the screen are rotatable in two upright bearing members or heads 102 which are mounted in the machine frame F. The frame is stiffened by two elongated hollow tie rods 202 which extend between the heads 102 in front of and behind the stencil 2. The manner in which the roll 3 may be driven is disclosed, for example, in my copending application Ser. No. 479,911 filed June 19, 1974.

Figure 3:
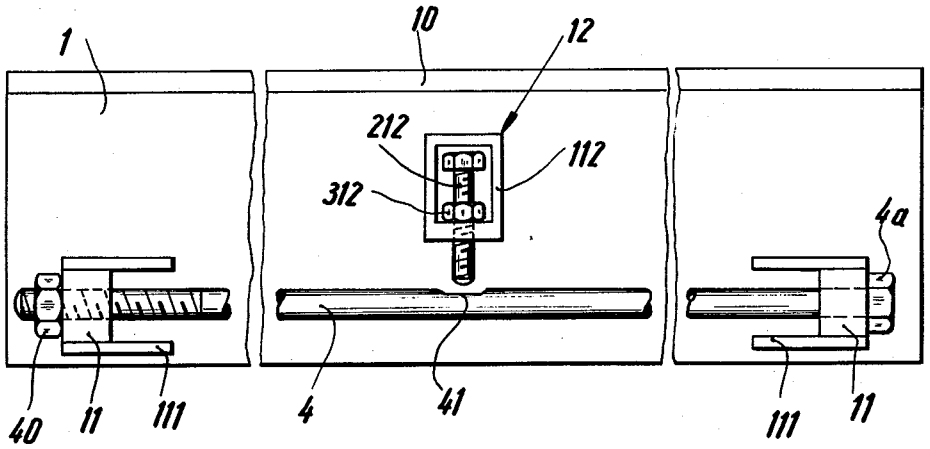
FIG. 3 is an enlarged fragmentary elevational view of the counter-pressure assembly in the machine of FIG. 1.
Figure 4:
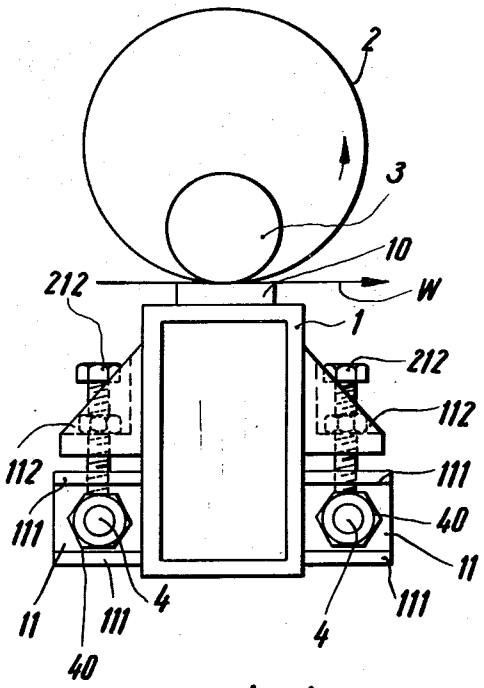
FIG. 4 is an end elevational view of the assembly of FIG. 3, further showing the fabric, the stencil and the liquid applying roll of the screen printing machine.

A web W of fabric or other material to be printed is transported along a horizontal path (see FIG. 3) so that it passes between the underside of the stencil 2 and a removable elongated strip or liner 10 which is secured to the narrow top surface of an elongated beam 1 forming part of the improved counter-pressure assembly. Members 10 and 1 thus together form an element of which member 10 is a first portion located nearer to, and member 1 is a second portion farther from the aforementioned path. The ends of the beam 1 are bolted or otherwise fixedly secured to the frame F below the respective heads 102. In he absence of any means for preventing or limiting its deformation, particularly a sagging of its median portion, the beam 1 would be likely to assume an arcuate shape so that the upper side of the strip 10 would constitute a concave surface and the width of the gap between the stencil 2 and strip 10 would increase in directions from both marginal portions toward the median portion of the fabric web W. Such tendency of the median portion of the beam 1 to bend or flex is especially pronounced if the stencil 2 is very long, i.e., if the machine is designed for the printing of wide webs or fabric or the like. The tendency to sag is attributable to the weight of the beam as well as to certain other factors, for example, when the liquid is to be applied to a long-piled fabric whose compression in the region of the marginal portions is different from that in the median portion thereof.

In accordance with the invention, the beam 1 is stiffened or reinforced by a mechanism which counteracts the sagging tendency and includes two elongated tie rods 4 adjacent to the two vertical side faces of the beam. The tie rods 4 are parallel with and extend along the lower portion of the beam 1, i.e., along that portion which is remote from the path for the web W and a customary back cloth (not shown) which is disposed between the web and the strip 10. The tie rods 4 extend through registering holes or openings in pairs of devices 11 (hereshown as short sleeves) which secure the tie rods to the lower portion of the beam 1. The sleeves 11 can be welded or otherwise rigidly secured to the beam 1 and preferably include pairs of reinforcing plates 111 which are also rigid with the beam. The head 4a of each tie rod 4 abuts against the outer side of one of the respective sleeves 11 and the other end of each tie rod is threaded to take a nut 40 which bears against the outer side of the other sleeve 11. By properly tensioning the tie rods 4, one can exert compression on the beam and cause the median portion of the beam 1 to tend to bulge upwardly below the central portion of the stencil 2. Such tendency counteracts the weight of the central part of the beam 1 and/or the pressure which may be exerted upon the strip 10 at one or more points between the ends of the beam. In other words, the nuts 40 can be applied with a force which suffices to maintain the upper side of the strip 10 in a plane which is parallel to the axis of the stencil 2 or to impart to the beam 1 a tendency to bulge upwardly in the region below the central portion of the stencil.

In order to check the tendency of tie rods 4 to flex upwardly between the respective sleeves 11, the counter-pressure assembly further comprises a pair of flexure controlling means 12 which are mounted on the beam 1 between the median portions of the tie rods 4 and the path for the web W. Each of these flexure controlling means comprises a carrier in the form of a bracket 112 which is welded or otherwise rigidly affixed to the respective side face of the beam 1, an adjustable externally threaded abutment member or bolt 212 which meshes with the bracket 112, and a lock nut 312 which can hold the bolt 212 in a selected axial position. The median portion of each tie rod 4 is preferably formed with a flat 41 which is adjacent to and can be engaged by the tip of the respective bolt 212. It is clear that the beam 1 can carry two or more flexure controlling means 12 for each of the tie rods 4. These tie rods are preferably adjacent to the lower third of the beam 1.

An advantage of the improved counter-pressure assembly is that the beam 1 can be held against sagging or other deformation, that the force with which the beam is held against deformation can be regulated, and that the configuration of the beam can be changed, if and when necessary so as to conform to the outline of the stencil and/or to take into consideration the nature of the fabric and/or back cloth. Furthermore, the beam can retain its shape even if the machine comprises a stencil having a substantial length (i.e., for treatment of a wide fabric) and even if the beam is subjected to a plurality of different deforming stresses which might fluctuate within a wide range.

The improved counter-pressure assembly is susceptible of many additional modifications without departing from the spirit of the invention. Thus, the beam 1 need not have a rectangular outline; for example, its cross-section may assume the shape of another polygon. Also, the width of the beam need not be constant and the flexure controlling means need not be mounted on the beam. Such flexure controlling means may be mounted on the foundation and may be designed to pull the median portions of the tie rods 4 in a direction away from the strip 10. Still further, the one-piece beam 1 can be replaced by several beams each of which carries one or more tie rods or the like.

Without further analysis, the foregoing will so fully reveal the gist of the present invention that others can, by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims:

1. In a screen printing machine wherein a web of material to be printed moves lengthwise in a predetermined path, a combination comprising a driven endless liquid-permeable stencil adjacent one side of said path for contacting portions of the moving web with a liquid; an elongated counter-pressure beam extending transversely of said path at the other side thereof opposite said stencil and having a first portion nearer to said path, a second portion remote from said path, and a side face, said beam being subject to bending stresses acting upon it in a region intermediate the end portions of the beam so that the latter tends to flex away from said stencil; and counteracting means adjacent said side face extending along said beam and secured to said end portions thereof for compressing said second portion of said beam so as to counteract said bending stresses and prevent the flexing of said beam away from said stencil.

2. A combination as defined in claim 1, wherein said counteracting means are operatively connected with said second portion of said beam.

3. A combination as defined in claim 2, wherein said beam has two longitudinally extending side faces and said counteracting means comprises at least one elongated tie rod, said tie rod being substantially parallel to said second portion of said beam, said counteracting means further comprising devices for securing the ends of said tie rod to said beam.

4. A combination as defined in claim 1, wherein said beam is a hollow body having a polygonal profile.

5. A combination as defined in claim 4, wherein said beam has a rectangular profile with two narrow and two wide outer side faces, said counteracting means being adjacent to one of said wide side faces and one of said narrow side faces facing towards said path.

6. A combination as defined in claim 5, further comprising a removable strip shaped liner provided on said one narrow side face of said beam.

7. A combination as defined in claim 1, said counteracting means comprising a tie rod extending along said beam and having respective ends secured to the same; and means engaging said tie rod intermediate said ends thereof for controlling tie-rod flexure and for thereby stabilizing the tension acting on said beam.

8. In a screen printing machine wherein a web of material to be printed moves lengthwise in a predetermined path, a combination comprising a driven endless liquid-permeable stencil adjacent one side of said path for contacting portions of the moving web with a liquid; an elongated counter-pressure beam extending transversely of said path at the other side thereof opposite said stencil, said beam being subject to bending stresses acting upon it in a region intermediate to ends of the beam so that the latter tends to flex away from said stencil, said beam comprising a first portion nearer to said path and a second portion remote from said path, said beam also having two side faces; and counteracting means operatively connected with said second portion of said beam to counteract said bending stresses so as to prevent the flexing of said beam away from said stencil, said counteracting means comprising two elongated tie rods each adjacent to one of said side faces and each being substantially parallel to said second portion of said beam, said counteracting means further comprising devices for securing the ends of said tie rods to said beam.

9. A combination as defined in claim 1, further comprising means for tensioning said tie rods, and means for controlling any flexure of said tie rods which results intermediate the ends thereof from such tensioning.

10. A combination as defined in claim 9, wherein said flexure controlling means is mounted on said beam.

11. A combination as defined in claim 8, wherein said devices comprise bearing members affixed to said beam and having openings for the respective tie rods.

12. A combination as defined in claim 11, wherein each of said bearing members includes at least one reinforcing extension rigid with said beam.

13. In a screen printing machine wherein a web of material to be printed moves lengthwise in a predetermined path, a combination comprising a driven endless liquid-permeable stencil adjacent one side of said path for contacting portions of the moving web with a liquid; an elongated counter-pressure beam extending transversely of said path at the other side thereof opposite said stencil, said beam being subject to bending stresses acting upon it in a region intermediate the ends of the beam so that the latter tends to flex away from said stencil, said beam including a first elongated portion adjacent to said path and a second elongated portion remote from said path and also having first and second elongated side faces; and counteracting means to counteract said bending stresses so as to prevent the flexing of said beam away from said stencil, said counteracting means comprising at least one elongated tensioned tie rod, said tie rod being adjacent to one of said side faces and to said second portion of said beam and said counteracting means further comprising devices for securing the ends of said tie rod to said beam, said counteracting means also comprising means for controlling flexure of said tie rod intermediate said devices which results from tensioning of the tie rod, including a carrier secured to said one side face of said beam between said path and said tie rod and an abutment member adjustably secured to said carrier and extending toward an intermediate portion of said tie rod to thus limit the extent of flexing of said intermediate portion toward said path.

14. A combination as defined in claim 13, wherein said abutment includes an externally threaded member meshing with said carrier and extending substantially at right angles to said tie rod.

15. A combination as defined in claim 14, wherein said flexure controlling means further comprises means for locking said externally threaded member in a selected position.

16. A combination as defined in claim 14, wherein said intermediate portion of said tie rod has a flat facet adjacent to said externally threaded member.

17. A combination as defined in claim 14, wherein said carrier is a bracket.

18. A combination as defined in claim 14, wherein said second portion is located at a level below said first portion of said beam and said threaded member is disposed midway between said devices, said threaded member having a vertical axis.

* * * * *